US005981909A

United States Patent [19]

Freeman

[11] Patent Number: 5,981,909

[45] Date of Patent: Nov. 9, 1999

[54] HEATED CAULK CASE

[76] Inventor: Carl M. Freeman, 2225 N. Wright Rd., Janesville, Wis. 53546

[21] Appl. No.: 08/740,375

[22] Filed: Oct. 29, 1996

[51] Int. Cl.[6] ..... B67D 5/62

[52] U.S. Cl. ..... 219/386; 222/146.5; 219/201

[58] Field of Search ..... 219/385, 386, 219/201, 214, 521, 535; 222/146.5

[56] References Cited

U.S. PATENT DOCUMENTS

| | | | |
|---|---|---|---|
| 1,659,719 | 2/1928 | Blake | 219/385 |
| 4,163,896 | 8/1979 | McAvinn et al. | 219/386 |
| 4,523,078 | 6/1985 | Lehmann | 219/386 |
| 4,974,752 | 12/1990 | Sirek | 222/146.5 |
| 5,397,875 | 3/1995 | Bechtold et al. | 219/521 |
| 5,615,805 | 4/1997 | Yoncak | 222/146.5 |

FOREIGN PATENT DOCUMENTS 2521408 8/1983 France .

*Primary Examiner*—Teresa Walberg
*Assistant Examiner*—J. Pelham
*Attorney, Agent, or Firm*—Ryan Kromholz & Manion, S.C.

[57] ABSTRACT

A heated caulk case for heating and storing a commonly used tube of sealing caulk, comprising a sealable box, a thermostatically controlled heating device, and a caulk tube tray. The heated caulk case provides a continuous and reusable method to achieve the benefits of lowering the viscosity of commonly used construction caulk such that the caulk will adhere better and provide a stronger seal between the caulked joint.

5 Claims, 1 Drawing Sheet

HEATED CAULK CASE

BACKGROUND OF THE INVENTION

The present invention relates generally to the caulking method of sealing and securing various construction joints or seams, and in particular, to heating and storing a commonly used tube of sealing caulk. More particularly, this invention relates to raising the temperature, and thereby lowering the viscosity of commonly used construction caulk such that the caulk can be more easily applied and provide the strongest adhesion possible.

Standard sealing caulk is a malleable chemical compound that is generally contained in, and dispensed from, an airtight container or tube. To facilitate the controlled dispensing of the caulking material, this tube is generally used in conjunction with a caulking gun. The caulking gun is used to house the tube and incrementally push the caulk through a small aperture in one end of the tube by pushing a retaining plate on the opposite end of the tube into, and through, the tube. These caulking guns exist in a variety of formats, all of which are operated manually or with the assistance of a powered pushing device.

While caulk has numerous uses, including hobbies and repair applications, it is used primarily in the construction of homes, buildings, and a variety of marine vehicles. Within homes and buildings, caulk is used most often to seal abutting sections of window and door frames within interior and exterior walls. Caulk is also used extensively throughout the construction of bathrooms to seal joining surfaces around sinks and counter tops, walls, showers, floors, as well as toilets.

For all of these uses, caulk is generally placed within the interior angle of two or more joining surfaces. For example, with the above bathroom uses, caulk is generally placed at the base of the shower section where it intersects the floor. The function of caulk in this, and the majority of caulking applications, is to seal moisture out of the caulked joint and prohibit leakage of water through the area and prevent mildew growth resulting from trapped moisture.

There are many varieties of caulks, each comprising a different chemical compound which is designed to provide specific colors, ultra violet ray resistance, mildew resistance, and hardening characteristics. When caulk is initially dispensed from a tube or other container, it is soft and easily spread by hand pressure. However, after a specified period of time exposed to air, (generally 6–24 hours) the caulk hardens to a rubbery or harder consistency.

In this way, caulk functions as a glue or filler between the two surfaces it is applied to. Because of this, the viscosity of the caulk when applied is important to the resulting strength of the seal once the caulk hardens. This is because the surface of all materials are, to varying degrees, porous. A porous surface, even microscopic, is better adhered to by a more viscous substance because it is more able to enter the small crevasses that make up the surface of the material. In the case of a wood surface, these crevasses are the grains across the surface of the wood. Once the caulk hardens, this infiltration into the surface provides a more watertight and stronger seal that is more resilient to wear, as well as the expanding and contracting caused by interior and exterior temperature changes.

While the ductility of the chemical composition of most caulks allows them to be applied at room temperature, the present invention provides a way to obtain the benefits of decreasing the viscosity of a caulk before it is applied. The present invention does this by heating the caulk and its containing tube to a controlled temperature (generally 85 to 95 degrees Fahrenheit). In addition, the present invention provides a means to maintain caulk at room temperature, or higher, for construction projects that occur in the winter. In this way, a worker using caulk within a variety of needs can increase the effectiveness and strength of the seal that caulk provides.

SUMMARY OF THE INVENTION

The present invention comprises a sealable insulated box having a base section, a top lid section, and an interior region. The sealable insulated box is used to store and heat several caulk tubes and a related caulking gun. The sealable box includes several housing cavities and trays used to secure a number of caulk tubes within the interior region, while a standard thermostatically controlled heating device uniformly heats the region within the box.

Because the high density and specific heat of caulking compound requires uniform and slow heating to lower its viscosity, the present invention utilizes insulated construction materials and multiple caulk tube housing cavities. These multiple cavities allow sufficient time for a user to circulate tubes of caulk into and out of the heated case in a continuous manner as one caulk tube is used up and replaced with a new tube.

Further, the present invention provides the ability to store a substantial amount of caulk on a work site overnight for use the next day. The present invention can also be used in recreational as well as commercial applications with readily available caulk tubes and caulk guns.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
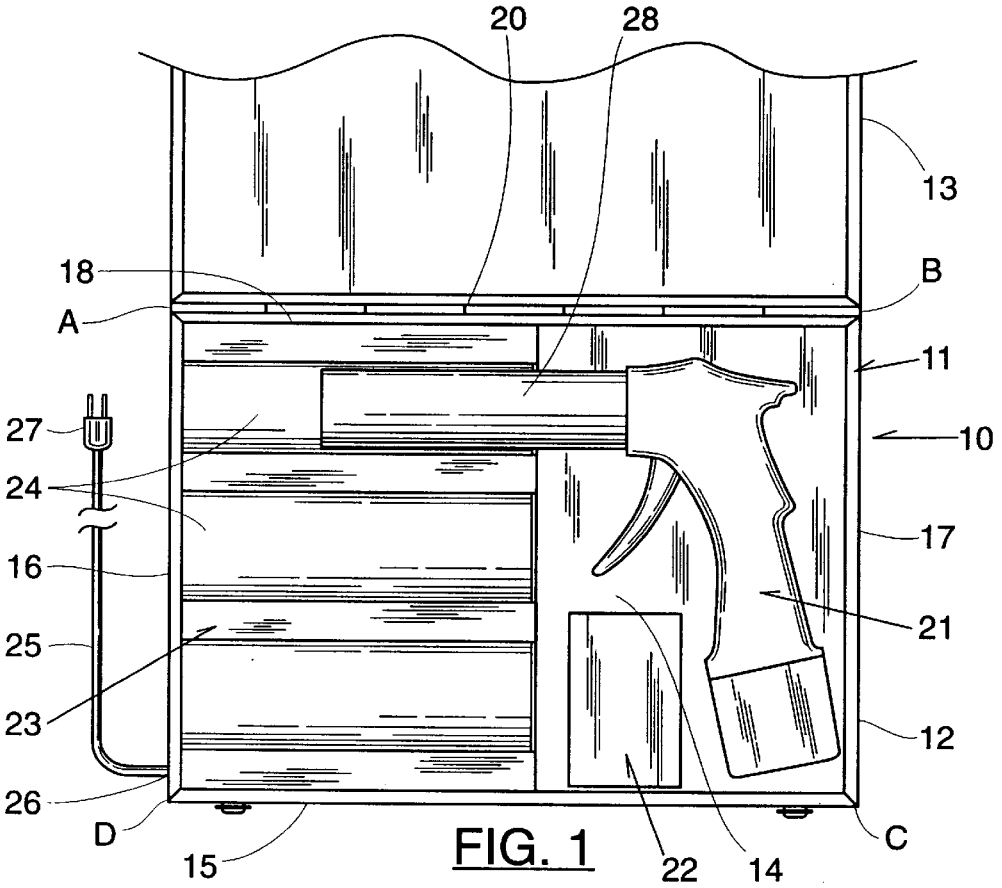
FIG. 1 is a top plan view of the heated caulk carrying case with the top lid section open.

With reference to FIG. 1, it will be noted that the heated caulk carrying case 10 of this invention comprises a sealable hinged box 11 made up of a base section 12, a top lid section 13, and an interior region 14. The base section 12 is further characterized by having a front side 15, a left side 16, a right side 17, a back side 18, and a bottom 19. The top lid section 13 is hingeably attached to the back side 18 of the base section 12 by means of a hinge 20 extending from position A to position B. The preferred construction and material of the sealable hinged box 11 is ¼ inch wood having insulating properties, but it is to be understood that a variety of material may be used to accomplish the same desired function.

Figure 3:
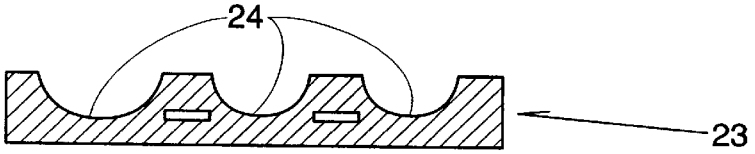
FIG. 3 is a side cut-away view of the caulk tube tray.

With additional reference to FIG. 1, contained within interior region 14 of the base section 12 of the caulk case 10 is a caulk gun 21 with an attached caulk tube 28, a heating device 22, and a caulk tube tray 23. Now referring to FIG. 3, the caulk tube tray 23 is further characterized by having a number of individual caulk tube housing cavities 24 used to hold extra caulk tubes (not shown) within the caulk tube tray 23. The caulk tube housing cavities 24 are preferably semi-cylindrical, but could be of any appropriate shape. Also disclosed in FIG. 1 is a power cord 25 attached through the base section 12 at position 26. Attached to one end of the power cord 25 there is an electrical plug device 27. The power cord 25 extends beneath the caulk tube tray 23 and to the heating device 22.

Figure 2:
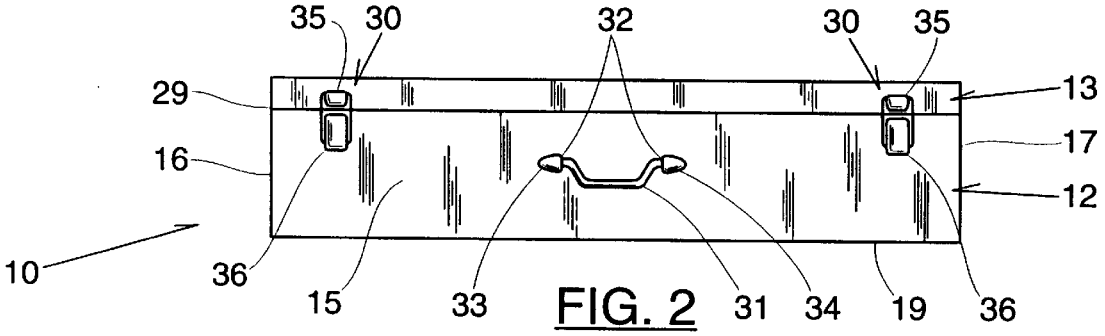
FIG. 2 is a front elevational view of the heated caulk carrying case showing the top lid section closed and the carrying handle.

With reference to FIG. 2, the heated caulk case 10 is shown in a closed position with the top lid section 13 sealed against the base section 12. The caulk case 10 comprises at least one releasable clasp 30, having a first member 35 fastened to the top lid section 13 and a corresponding second member 36 fastened to the top lid section 13 and a corresponding second member 36 fastened to the base section 12. For the preferred embodiment of my invention, two releasable clasps 30 are used, but any fastening device could be used to seal the top lid section 13 against the base section 12. Attached to the base section 12 is a carrying handle 31 with ends 32 that are hingeably received within receptacles 33 and 34.

In use, the releasable clasps 30 securing the top lid section 13 to the base section 12 are released and the interior region 14 is exposed by pivoting the top lid section 13 on hinge 20. A caulk gun 21 and an attached caulk tube 28 are placed within the interior region 14 of the base section 12 along with any extra caulk tubes (not shown) in the caulk tube housing cavities 24 of the caulk tube tray 23. The top lid section 13 is then closed and fastened to the base section 12 by securing the clasps 30. The electrical plug device 27 is next inserted into a standard electrical outlet (not shown) to provide power to the heating device 22. This thermostatically, self-controlled, heating device 22 represents a commercially available unit which can be set to maintain a range of temperatures and acts to heat the air within the interior region 14 of the box 11 when closed. Warmed, caulk tubes are removed for use and are replaced with unwarmed tubes within the heated caulk case 10 as needed.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been describe, the details may be changed without departing from the invention, which is defined by the claims.

What is claimed is:

1. In a caulk heating apparatus including a heating device for increasing and preserving the temperature of caulking material contained within a tube, the apparatus comprising:

a sealable box having a base section, a top lid section, and an interior region;

at least one caulk tube tray contained within said interior region;

at least one fastening device between said top lid section and said base.

2. The caulk heating apparatus of claim 1, wherein said caulk tube tray comprises at least one caulk tube housing cavity.

3. The caulk heating apparatus of claim 2, wherein said caulk tube housing cavity has a tube supporting portion substantially conforming to a portion of the exterior of said caulk tube.

4. The caulk heating apparatus of claim 1, wherein said interior region contains a plurality of caulk tube trays, one of said trays being positioned to accept a caulk tube attached to caulk gun, and the remaining trays being arranged to support unattached caulk tubes.

5. A method for heating and storing caulk tubes, using a caulk heating apparatus comprising a sealable box, having a top lid section, a base section, and an interior region, a heating device and a plurality of caulk tube trays nested within said interior region, a method comprising:

positioning a caulk gun containing a caulk tube within said interior region;

placing additional caulk tubes within the remaining said caulk tube trays;

fastening said top lid section to said base section;

heating said sealable box to a predetermined temperature.

* * * * *